US011530519B2

(12) United States Patent
Tupala

(10) Patent No.: US 11,530,519 B2
(45) Date of Patent: Dec. 20, 2022

(54) PILE JOINT

(71) Applicant: Leimet Oy, Lappi (FI)

(72) Inventor: Teemu Tupala, Säkylä (FI)

(73) Assignee: Leimet Oy, Lappi (FI)

( * ) Notice: Subject to any disclaimer, the term of this patent is extended or adjusted under 35 U.S.C. 154(b) by 0 days.

(21) Appl. No.: 17/290,951

(22) PCT Filed: Nov. 6, 2019

(86) PCT No.: PCT/FI2019/050789
§ 371 (c)(1),
(2) Date: May 3, 2021

(87) PCT Pub. No.: WO2020/094923
PCT Pub. Date: May 14, 2020

(65) Prior Publication Data

US 2021/0388570 A1 Dec. 16, 2021

(30) Foreign Application Priority Data

Nov. 7, 2018 (FI) ..... 20185944

(51) Int. Cl.
*E02D 5/52* (2006.01)
*E02D 5/30* (2006.01)

(52) U.S. Cl.
CPC ..... *E02D 5/526* (2013.01); *E02D 5/30* (2013.01)

(58) Field of Classification Search
CPC combination set(s) only.
See application file for complete search history.

(56) References Cited

U.S. PATENT DOCUMENTS 3,884,589 A * 5/1975 Liedholm ..... E02D 5/523 403/374.2
4,362,416 A * 12/1982 Kaimo ..... E02D 5/523 403/374.2

(Continued)

FOREIGN PATENT DOCUMENTS

DK 99976 C 10/1964
EP 2186944 A2 5/2010

(Continued)

OTHER PUBLICATIONS

International Search Report and Written Opinion for International Application No. PCT/FI2019/050789 dated Feb. 10, 2020.

(Continued)

*Primary Examiner* — Kyle Armstrong
(74) *Attorney, Agent, or Firm* — Meunier Carlin & Curfman LLC

(57) ABSTRACT

The invention relates to a pile joint, which comprises a first concrete pile, a second concrete pile, and a coupling system therebetween for connecting and locking the concrete piles relative to each other. The coupling system includes a lock housing and a lock spindle connectible to each other and provided with transverse holes in such a way that the lock housing's transverse holes and the lock spindle's transverse hole settle substantially in line with each other for receiving a locking pin when the lock housing and the lock spindle are connected to each other. In addition, the lock housing is provided with a locking ring for retaining the locking pin in a position locking the lock housing and the lock spindle to each other. For ensuring the pipe joint's installation and durability there is in alignment with a first transverse hole of the lock housing a guidance pipe and in alignment with a second transverse hole of the lock housing, opposite to its first hole, a locking seat closed at one end and intended for the locking ring. The locking ring is adapted to be movable (Continued)

in a groove included in the locking seat and the locking pin is provided with a recess in the lengthwise direction of the locking pin to receive the locking ring.

14 Claims, 3 Drawing Sheets

(56) References Cited

U.S. PATENT DOCUMENTS

| | | | | | |
|---|---|---|---|---|---|
| 4,362,417 | A | * | 12/1982 | Vesa | E02D 5/523 403/374.2 |
| 4,812,098 | A | * | 3/1989 | Kaimo | E04B 1/215 411/326 |
| 4,865,503 | A | * | 9/1989 | Kaimo | E04B 1/215 411/513 |
| 4,865,504 | A | * | 9/1989 | Kaimo | E04B 1/215 411/522 |

FOREIGN PATENT DOCUMENTS

| | | | |
|---|---|---|---|
| EP | 2204498 | A1 | 7/2010 |
| SE | 214150 | C1 | 11/1966 |
| WO | 2008128025 | A1 | 10/2008 |

OTHER PUBLICATIONS

Search Report for Finnish Application No. 20185944 dated Jun. 4, 2019.

* cited by examiner

PILE JOINT

PRIORITY

This is a U.S. national stage application of the international application number PCT/FI2019/050789 filed on Nov. 6, 2019, and claiming priority of FI 20185944 filed on Nov. 7, 2019, the contents of both of which are incorporated herein by reference.

The invention relates to a pile joint, which comprises a first concrete pile, a second concrete pile, and a coupling system therebetween for connecting and locking the concrete piles relative to each other, or which comprises a concrete pile, a rock point, and a coupling system therebetween for connecting and locking the concrete pile and the rock point relative to each other, said coupling system including a lock housing and a lock spindle connectible to each other, said lock housing and lock spindle being provided with transverse holes in such a way that the lock housing's transverse holes and the lock spindle's transverse hole settle substantially in line with each other for receiving a locking pin when the lock housing and the lock spindle are connected to each other, the lock housing being provided with a locking ring for retaining the locking pin in a position locking the lock housing and the lock spindle to each other according to the pre-characterizing portion of claim 1.

PRIOR ART

Traditionally, concrete piles or reinforced concrete piles are connected to each other in an end-to-end manner by means of a so-called extension joint for providing a desired actual length for a driven pile being composed of the piles. In the extension joint, each end-to-end joinable concrete pile comprises joint elements connectible to each other.

Publication FI 112816/EP 1 127 195 B1 relates to an extension joint for concrete piles, wherein the end-to-end connectible piles are provided with overlappingly disposable joining loops and with locking pins adapted to pass through the over-lappingly disposable joining loops. The extension joint and its locking system are well capable of withstanding heavy loads applied to the extension joint, but the tightness of the extension joint is not sufficient for demanding uses of piles, which has an adverse effect on the strength and stability of the joint.

Publication FI 125276 B relates to an extension joint for concrete piles, including a lock housing and a lock spindle capable of being fitted to each other and provided with transverse holes for receiving a insert pin. The insert pin is guided by a guiding tube, which is provided with protective plugs to avoid penetration of concrete into the lock housing during a joining process. The locking of the insert pin is uncertain, whereby the reliability of the extension joint is doubtful.

Publication FI 8230/EP 2 186 944 B1 relates to a locking assurance construction in an extension joint for precast reinforced concrete piles. The locking construction comprises a lock spindle that is fitted in a lock housing included in the extension joint, the relative positions thereof being secured with a locking ring fitted in the lock housing by means of an insert pin. The insert pin and locking ring of the known solution involve weaknesses regarding the holding characteristics thereof and the installation reliability and tightness of the joint.

SUMMARY OF THE INVENTION

An objective of the invention is to provide a pile joint with sufficient stability and easy and reliable installation irrespective of prevailing conditions. The pile joint must also withstand the loads applied thereto. This objective is attained according to claim 1.

The basic idea of the invention is to secure the placement and retention of a locking pin in a lock housing and lock spindle junction included in a pile joint coupling system, i.e. in practice in the transverse holes thereof substantially aligned with each other. This is implemented in such a way that in alignment with a first transverse hole of the lock housing is a guidance pipe and in alignment with a second transverse hole of the lock housing, opposite to its first hole, is a locking seat closed at one end and intended for a locking ring. The locking ring is adapted to be movable in a groove included in the locking seat and the locking pin is provided with a recess in the lengthwise direction of the locking pin for receiving the locking ring. When the locking pin is installed, or more exactly struck through the transverse holes of the integrated lock housing and lock spindle, the locking ring will be positioned in alignment with the recess of the locking pin and secures the pile joint. The locking pin has a given clearance in the lengthwise direction. The holding capacity of the locking is not dependent on friction. The locking is durable and reliable provided that the components of the coupling system do not break, which can be avoided by appropriate material selection.

In case the locking pin is installed by striking, i.e. in practice manually, it will be easier to insert the locking pin all the way to the bottom, i.e. in such a way that an end of the locking pin (trailing end of the locking pin), which is opposite to the end that settles in the locking seat of the lock housing, will settle on the surface of a concrete pile or a so-called box shoe (the box shoe will be described later in more detail). The locking pin can also be installed with a clamp. When using a clamp for installation, a placement of the locking pin all the way to the bottom is somewhat difficult. Drawbacks involved in this are obviated by providing the locking pin with a recess in the lengthwise direction as mentioned above, which allows for a larger installation tolerance.

The lock housing, the guidance pipe, and the locking seat are preferably constructed in one piece. Hereby is ensured that concrete or other unwanted matter cannot penetrate the coupling system.

The locking ring is preferably discontinuous and has an outer diameter, an inner diameter, and a thickness. The discontinuity ensures striking of the locking pin through the locking ring in such a way that the locking ring is able to resume its initial shape.

The groove of the locking seat has a diameter which is preferably larger than the outer diameter of the locking ring, which facilitates installation of the locking ring and gives it a certain clearance in the groove of the locking seat.

The inner diameter of the locking ring is preferably smaller than a diameter of the recess in the lengthwise direction of the locking pin. Hence, the locking ring lightly tightens around the locking pin within the lengthwise recess.

The locking pin preferably has a basic diameter, whereby the diameter of the lengthwise recess is smaller than said basic diameter. In addition, the locking pin has its recess in the lengthwise direction preferably adapted in such a way that an end of the locking pin is left with a portion whose diameter is larger than the inner diameter of the locking ring. Thereby the retention of the locking pin in the locking ring is ensured.

The end of the locking pin is preferably tapered in such a way that the locking ring fits better around the locking pin.

The recess of the locking pin has a length which is preferably multiple with respect to the thickness of the locking ring, which provides the locking pin with a certain lengthwise clearance.

The pile joint preferably comprises several lock housings and lock spindles, the lock housings and the lock spindles being disposed so as to have both the first pile and the second pile provided with at least two lock housings and at least two lock spindles respectively. In addition, the lock housings and the lock spindles are disposed diagonally relative to each other at the ends of the first and second concrete piles. This ensures stability and durability of the pile joint. The lock housings and lock spindles are disposed at a specific distance from the edges of the end of the concrete pile, the distance preferably matching the length of the guidance pipe.

The pile joint, comprising a concrete pile and a rock point, preferably comprises several lock housings and lock spindles, the lock housings and the lock spindles being disposed so as to have both the concrete pile and the rock point provided with at least two lock housings and at least two lock spindles respectively. In addition, the lock housings and the lock spindles are disposed diagonally relative to each other at an end of the concrete pile and at a bottom plate of the rock point. This enhances stability and durability of the pile joint. The lock housings and lock spindles are disposed at a specific distance from the edges of the concrete pile and those of the bottom plates of the rock point, the distance preferably matching the length of the guidance pipe.

Preferred embodiments of a pile joint according to the invention are given in the dependent claims.

BRIEF DESCRIPTION OF THE DRAWINGS

The invention will now be described, by way of example only, with reference to the attached schematic drawings, in which.

DETAILED DESCRIPTION

Figure 1:
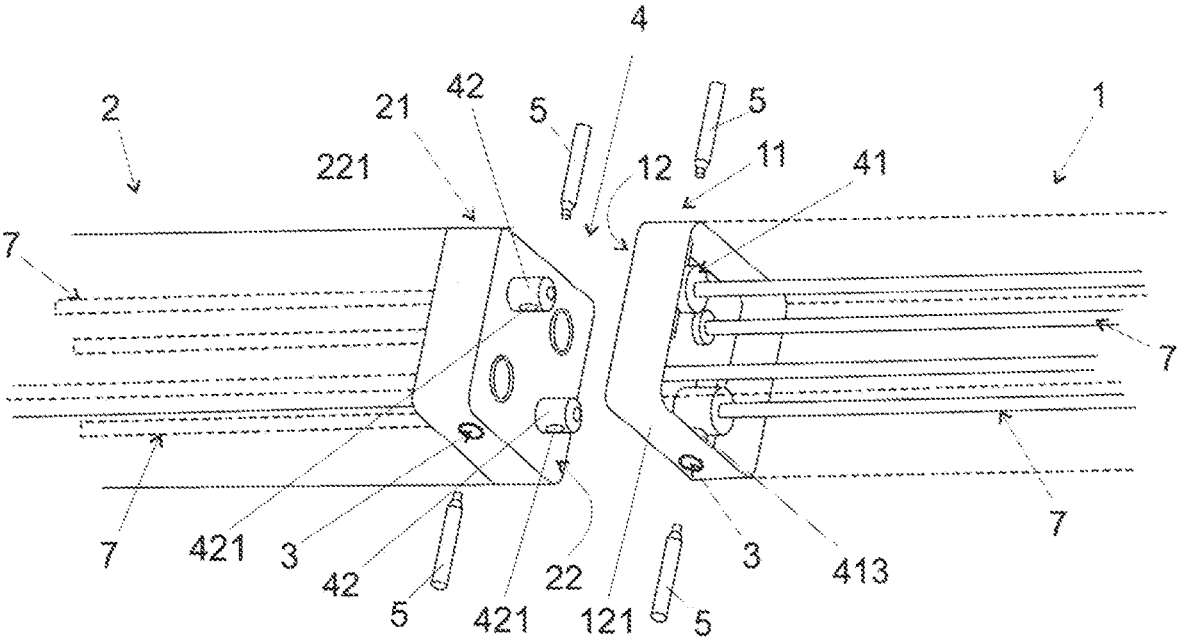
FIG. 1 shows an embodiment of a pile joint according to the invention.

The pile joint according to an embodiment of the invention, illustrated in FIG. 1, consists of a first concrete pile 1 having a first end 11 and of a second pile 2 connectible in an end-to-end manner to the first concrete pile and having a second end 21. The first concrete pile 1 has its first end 11 preferably provided with a first end plate 12, which may include sides 121 for an enhanced fitting of the end plate. Respectively, the second concrete pile 2 has its second end 21 preferably provided with a second end plate 22, which may include sides 221 for an enhanced fitting of the end plate. The plates with sides are also referred to as box shoes. The sides of the end plates are provided with apertures 3 for receiving locking pins 5 (described subsequently in more detail).

Figure 2:
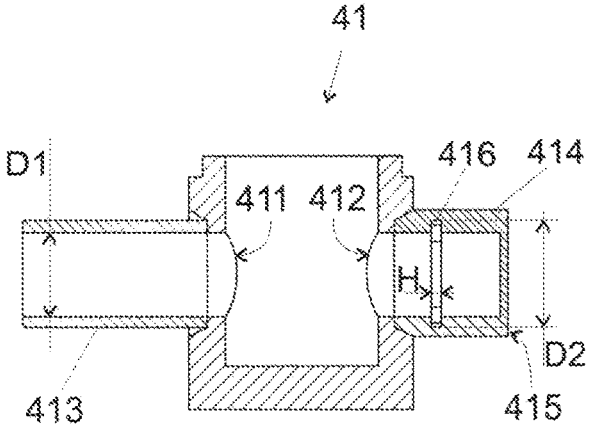
FIG. 2 shows a lock housing of the coupling system.
Figure 5:
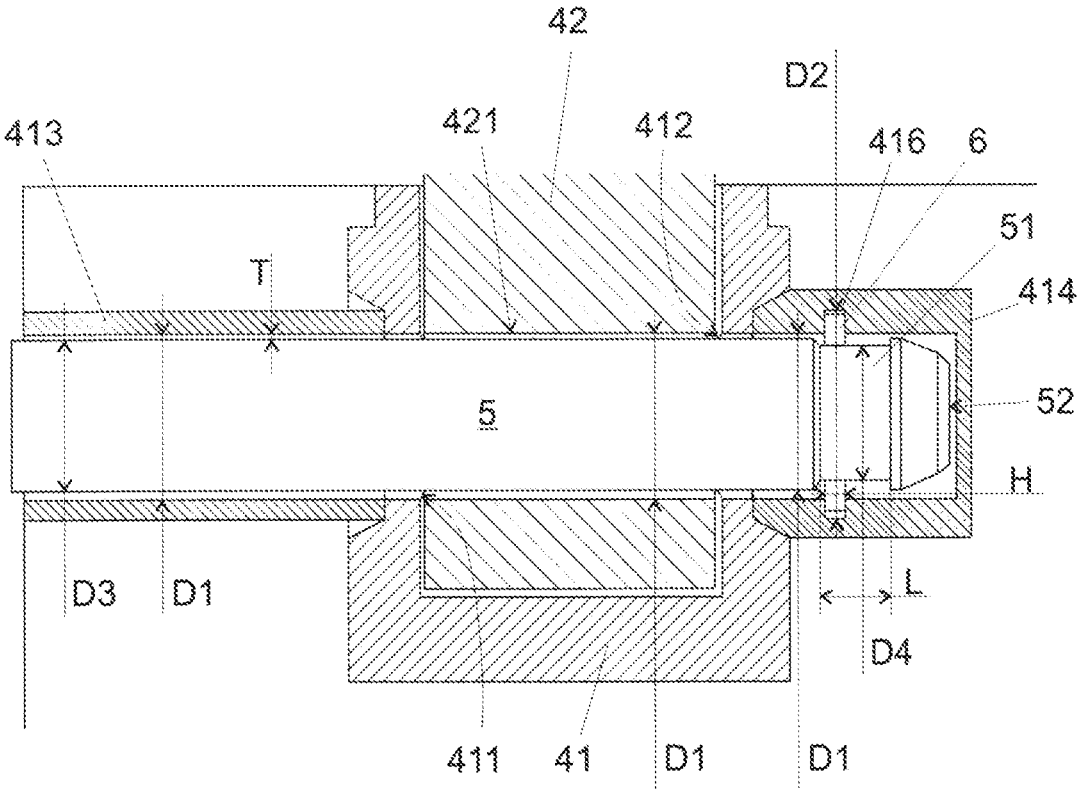
FIG. 5 shows a junction between the lock housing and the lock spindle.

The pile joint comprises a coupling system 4 for connecting and locking concrete piles in an end-to-end manner relative to each other. The coupling system 4 comprises a lock housing 41 and a lock spindle 42. The lock housing 41 is provided with transverse holes 411 and 412 and the lock spindle 42 is provided with a transverse hole 421 intended to be aligned with each other for receiving a locking pin 5 (FIGS. 2 and 5). The lock housing and the lock spindle are preferably cylindrical so that the fitting of a cylindrical lock spindle within a cylindrical internal recess of the cylindrical lock housing is tight for providing a secure joint. If end plates are used, the end plates will be provided with apertures for the lock housing 41 and the lock spindle 42. The lock housing and lock spindle of the coupling system are fastened by welding or with a screw thread to reinforcement bars 7 anchored within the pile during a casting process.

In the first pile 1, the lock housing 41 is left inside the first end 11 of the first concrete pile 1 in such a way that the lock housing has its mouth settling on a surface of the first end 11, i.e. on the end plate 12 to which the lock housing is attached. In the second pile 2, the lock spindle 42 protrudes from the second end 21 of the second concrete pile 2, i.e. from the end plate 22. In the pile joint, as the concrete piles are being connected and are connected to each other in an end-to-end manner, the lock spindle 42 settles inside the lock housing 41, whereby the first concrete pile 1 has its first end 11 and the second concrete pile 2 has its second end 12 settling tightly against each other.

FIGS. 2 and 5 illustrate the lock housing in more detail. The lock housing 41 is provided with a first transverse hole 411 and with a second transverse hole 412 opposite to the first transverse hole 411. The lock spindle 42 (FIGS. 1 and 5) is provided with a transverse hole 421, such that transverse holes of the lock housing and the transverse hole of the lock spindle settle substantially in line with each other for receiving a cylindrical locking pin 5 when the lock housing and the lock spindle are connected to each other. The intention is that the locking pin functions to some extent in a spring-like manner, pulling the pile joint together. The transverse holes have their diameters D1 complying with (an installation tolerance T is also described below) the basic diameter D3 of locking pin. Thus, the term "substantially" is intended to indicate that the holes are not exactly in alignment, whereby the locking pin makes a little bend as it passes through a guidance pipe 413 of the lock housing 41 into a locking seat 414 of the lock housing 41 (the lock housing will be described later in more detail).

Figure 3:
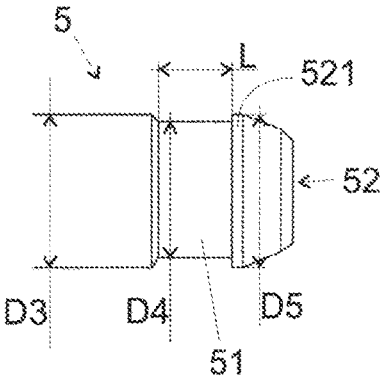
FIG. 3 shows a locking pin of the coupling system.

The locking pin 5 is elongated and cylindrical. The locking pin 5 has its end 52, which is to be inserted, or in practice struck, into the locking seat 414 of the lock housing 41, comprising a recess 51 in a lengthwise direction of the locking pin 5 and whose diameter D4 is smaller than the basic diameter D3 of the locking pin. The lengthwise recess 51 extends across a part of the total length of the locking pin. The recess is designed so that the end 52 of the locking pin 5 is left with a portion 521 whose diameter D5 is preferably slightly larger than an internal diameter D7 of a locking ring 6. The discussed diameter D5 can be the same as the basic diameter D3 of the locking pin. The length of the lengthwise recess 51 is indicated by reference character L. An edge of the recess 51 of the locking pin 5, which edge is the one closer to the end 52 of the locking pin, is preferably vertical for enhancing retention capacity of the locking ring 6. The opposite edge can be chamfered or vertical. This is illustrated in FIG. 3.

The lock housing 41 is at the first transverse hole 411 equipped with a guidance pipe 413 and at the second transverse hole 412 equipped with a cylindrical locking seat 414, which is closed at its end 415 facing away from the lock housing 41. The end of the guidance pipe 413 of the lock housing 41, which end faces away from the lock housing, is intended to be placed at the surface of an edge of the concrete pile. If an end plate is used, at the surface of this end plate. Thus, the only open part of the lock housing on the outside is the mouth of the guidance pipe, into which the locking pin 5 is struck. The guidance pipe may have its mouth provided for example with a plastic cap (not shown) thereby ensuring that concrete does not penetrate the structure. The locking pin can be installed in its position through the plastic cap. This is further ensured with a tight junction between the lock housing and the lock spindle. The guidance pipe 413 and the locking seat 414 have their diameters complying with the diameter D1 of the transverse holes 411 and 412 of the lock housing.

Figure 4:
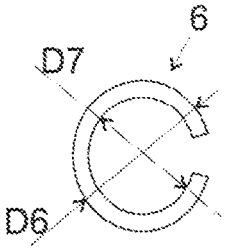
FIG. 4 shows a locking ring disposable in a locking seat of the lock housing.

The locking pin 5 is intended to be inserted, or rather struck, by way of the guidance pipe 413 through the transverse holes 411 and 412 of the lock housing as well as through the transverse hole 421 of the lock spindle 42 so that the end 52 of the locking pin 5 settles in the locking seat 414. The locking seat 414 has its inner periphery provided with a groove 416 for receiving the locking ring 6 (FIG. 4). The groove 416 has its diameter indicated with reference character D2.

The locking ring 6 is preferably incomplete, i.e. discontinuous, as illustrated in FIG. 4 for being easily fitted in the groove 416. The locking ring 6 has an outside diameter D6 which is preferably slightly smaller than the diameter D2 of the groove 416 of the locking seat 414 for easier installation of the locking ring. Hence, the locking ring 6 is able to move freely in the groove 416 of the locking seat 414 and to center around the locking pin 5. The locking ring 6 has an inside diameter D7 which is preferably slightly smaller than the diameter D4 of the recess 51 in the lengthwise direction of the locking pin 5. The locking ring 6 has its thickness indicated with reference character H.

The recess 51 of the locking pin 5 has a length L which in the longitudinal direction of the locking pin 5 is multiple with respect to the thickness H of the locking ring so that the locking pin 5 is able to move, at least in a lengthwise direction, to some extent in the locking ring 6, i.e. actually in a junction of the lock housing and the lock spindle, on the side closer to locking seat 414. An appropriate installation tolerance T is reserved between the basic diameter D3 of the locking pin 5 and the transverse holes 411 and 412 of the lock housing 41 and the transverse hole 421 of the lock spindle 42 for installation of the locking pin 5. The locking pin 5 preferably has a tapered end, which facilitates placing the locking ring 6 around the locking pin 5. Therefore, striking the locking pin through the locking ring 6 can be facilitated and ensured. Being discontinuous, the locking ring 6 is able to expand in the groove 416 of the lock housing 41 so as to enable the end 52 of the locking pin 5 to pass through the locking ring 6 in the in the striking phase. Regarding its properties, the material for the locking ring 6 is selected so as to enable the locking ring 6 to resume its original shape after being struck. Accordingly, the locking ring 6 settles within the boundaries of the recess 51 of the locking pin 5. The locking ring 6 behaves in a similar manner when being installed in the peripheral groove 416 included in the locking seat 414 of the lock housing 41.

The coupling system may include several lock housings and lock spindles, i.e. lock housing-lock spindle couples. The lock housings 41 and the lock spindles 42 are adapted according to this embodiment preferably in such a way that both the first concrete pile 1 and the second concrete pile 2 are provided with two lock housings and two lock spindles. In addition, the lock housings and the lock spindles are disposed diagonally relative to each other at the ends of the first and second concrete piles, i.e. in connection with the end plates, at a specific distance from the edges of the ends of the concrete piles, the distance preferably matching the length of the guidance pipe.

Other types of configurations are also possible. The coupling system may also comprise just one lock housing-and-lock spindle combination, although such a combination has not been shown in the attached figures or in respective parts of description.

The assembly of the pile joint takes place as follows.

The first concrete pile 1 and the second concrete pile 2 are placed end to end so that the lock spindles 42 are pushed into the respective lock housings 41. This is followed by striking the locking pins 5 through the apertures 3 included in the sides 121 and 221 of the end plates 12 and 22 present on the ends 11 and 21 of the concrete piles 1 and 2 so that the locking pins, being guided by the guidance pipes 413 of the lock housings 41, pass through the transverse holes 411, 412 and 421 of the lock housings 41 and the lock spindles 42 all the way into the lock housings' locking seats 414 which are closed at their ends. Hence, the discontinuous locking rings 6 present in the internal grooves 416 of the locking seats 414 first expand as the ends 52 of the locking pins 5 penetrate through the locking rings, followed by the locking rings resuming the initial shape thereof settling in the recesses 51 in the lengthwise direction of the locking pins 5. Thereby a joint of the lock housings and the lock spindles is obtained, wherein the locking pins have a certain lengthwise clearance equal to the length L of the recess 51 in the lengthwise direction of the locking pins 5. As described above, the transverse holes of the lock housings and the transverse holes of the lock spindles are not in precise alignment (the term "substantially"), which secures the joint as the locking pin functions in a spring-like manner.

The above-described appropriate installation tolerance T between the transverse holes 411, 412 and 421 of the lock housings 41 and the lock spindles 42 and the diameters of locking pins facilitates the installation of the locking pins and the construction of the joint. In addition, the tapered ends 52 of the locking pins 5 facilitate the positioning of the locking rings 6 in alignment with the recesses in the lengthwise direction of the locking pins.

Figure 6:
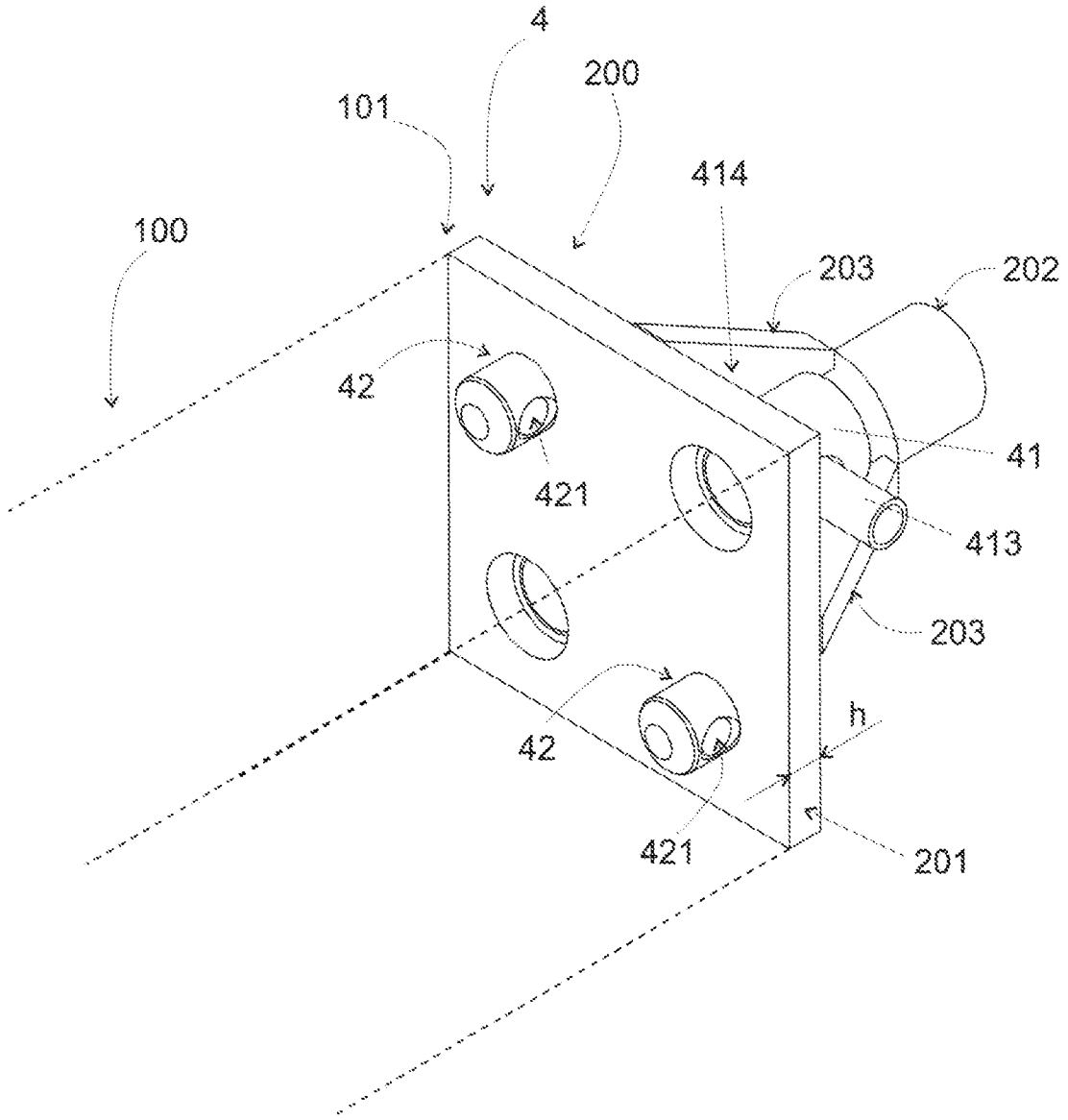
FIG. 6 shows another embodiment of a pile joint according to the invention.

The pile joint according to a second embodiment of the invention, shown in FIG. 6, consists of a concrete pile 100 having an end 101, and of a rock point 200 provided with a bottom plate 201. The concrete pile and the rock point are attached to each other so that the concrete pile has its end abutting against the bottom plate of the rock point. The rock point is further provided with a tip portion 202 and support wedges 203. The concrete pile is preferably provided with an end plate including sides, i.e. with a box shoe, as described above.

The pile joint comprises a coupling system 4, which in an essential manner corresponds with the coupling system presented in FIGS. 1-5. FIG. 6 shows the reference numerals for the lock housing 41, the guidance pipe 413 of the lock housing, the locking seat 414 of the lock housing, the lock spindle 42, and the transverse hole 421 of the lock spindle.

In this embodiment, the components of the coupling system on the side of the pile 100 are not specifically illustrated. In practice, they would correspond to the components of the coupling system on the side of the concrete pile 2 according to FIG. 1. Respectively, the components of the coupling system on the side of the rock point 200 would correspond to the components of the coupling system on the side of the first concrete pile 1 (in a different viewing angle).

As for the rock point 200, the components do not settle in the concrete in the same way as in the piles. On the side of the rock point, the lock housing 41 is left outside the bottom plate 201 of the rock point, whereby also the guidance pipe 413 and the locking seat 414 of the lock housing are left outside the bottom plate of the rock point, i.e. in practice on a side of the bottom plate 201 opposite to the concrete pile 100 as shown in FIG. 6. The locking pin 5 (not shown) is nevertheless installed in a similar manner by way of the guidance pipe 413. The lock housing 41 and the lock spindle 42 are fastened to the bottom plate 201 preferably by welding. The bottom plate 201 has a specific thickness h, which must be considered with regard to the depth and length of the lock housing and lock spindle so as to make the joint tight as described above.

The support wedges 203 of the rock point 200 are preferably disposed in a manner to support both the rock point structure and the components of the coupling system.

The coupling system may include several lock housings and lock spindles, i.e. lock housing-lock spindle couples. According to this embodiment, as shown in FIG. 6, the lock housings 41 and the lock spindles 42 are preferably disposed so that both the concrete pile 100 and the rock point 200 are provided with two lock housings and two lock spindles. In addition, the lock housings and the lock spindles are positioned diagonally in relation to each other at the end 101 of the concrete pile 100, i.e. preferably in connection with the used end plate, and on the bottom plate 201 of the rock point 200, at a specific distance from the edges of end of the concrete pile and the bottom plate of the rock point, the distance preferably matching the length of the guidance pipe.

Other types of configurations are also possible. The coupling system may also comprise just one lock housing-lock spindle combination although such a combination has not been shown in FIG. 6 or in the part of description related thereto.

The assembly of the pile joint takes place in a similar manner as described above.

Above, the guidance pipe, the locking seat, the lock spindle and the locking pin are described as cylindrical. It is obvious that these components may also have other types of cross-sections, being for example quadratic or hexagonal, etc. The shape of the locking ring must of course be considered in view of this. It is obvious that the concrete pile and the bottom plate of the rock point also may have cross-sections other than quadratic.

The invention may vary in detail, for example with regard to the attachment, configuration and number of lock housings and lock spindles, as well with regard to the cross-section of the above-mentioned components, etc., within the scope of the appended claims.

The invention claimed is:

1. A pile joint, which comprises a first concrete pile, a second concrete pile, and a coupling system therebetween for connecting and locking the first and the second concrete pile relative to each other, or which comprises a concrete pile, a rock point, and a coupling system therebetween for connecting and locking the concrete pile and the rock point relative to each other, said coupling system including a lock housing and a lock spindle connectible to each other, said lock housing and lock spindle being provided with transverse holes in such a way that the lock housing's transverse holes and the lock spindle's transverse hole settle substantially in line with each other for receiving a locking pin when the lock housing and the lock spindle are connected to each other, the lock housing being provided with a locking ring for retaining the locking pin in a position locking the lock housing and the lock spindle to each other, wherein in alignment with a first transverse hole of the lock housing is a guidance pipe and in alignment with a second transverse hole of the lock housing, opposite to its first hole, is a locking seat closed at one end and intended for the locking ring, the locking ring is adapted to be movable in a groove included in the locking seat, and wherein the locking pin is provided with a recess in a lengthwise direction of the locking pin for receiving the locking ring, and wherein the locking ring, once struck into the locking groove, is permanently disposed within the locking seat.

2. The pile joint according to claim 1, wherein the locking ring is discontinuous and the locking ring has an outer diameter, an inner diameter, and a thickness.

3. The pile joint according to claim 2, wherein the groove of the locking seat has a diameter which is larger than the outer diameter of the locking ring.

4. The pile joint according to claim 2, wherein the inner diameter of the locking ring is smaller than a diameter of the locking pin's recess in the lengthwise direction.

5. The pile joint according to claim 4, wherein the locking pin has a basic diameter and the diameter of the locking pin's recess in the lengthwise direction is smaller than said basic diameter.

6. The pile joint according to claim 4, wherein the locking pin has the recess in the lengthwise direction adapted in such a way that an end of the locking pin is left with a portion whose diameter is larger than the diameter of the locking pin's recess in the lengthwise direction.

7. The pile joint according to claim 1, wherein an end of the locking pin is tapered.

8. The pile joint according to claim 2, wherein the recess of the locking pin has a length which is multiple with respect to the thickness of the locking ring.

9. The pile joint according to claim 1, wherein an end of the first concrete pile is equipped with an end plate, which is provided with sides.

10. The pile joint according to claim 1, wherein an end of the second concrete pile is equipped with an end plate, which is provided with sides.

11. The pile joint according to claim 1, wherein the pile joint comprises several lock housings and lock spindles and the lock housings and the lock spindles are disposed so as to have both the first concrete pile and the second concrete pile provided with at least two lock housings and with at least two lock spindles.

12. The pile joint according to claim 11, wherein the lock housings and the lock spindles are disposed diagonally relative to each other at the ends of the first concrete pile and the second concrete pile, at a specific distance from the edges of the ends of the concrete piles.

13. The pile joint according to claim 1, wherein the pile joint comprises several lock housings and lock spindles and the lock housings and the lock spindles are disposed so as to have both the concrete pile and the rock point provided with at least two lock housings and with at least two lock spindles.

14. The pile joint according to claim 13, wherein the lock housings and the lock spindles are disposed diagonally relative to each other at an end of the concrete pile and at a bottom plate of the rock point, at a specific distance from the edges thereof.

* * * * *